US007392634B1

(12) United States Patent
Maye et al.

(10) Patent No.: US 7,392,634 B1
(45) Date of Patent: Jul. 1, 2008

(54) WEB PRINTING AND FEED MACHINE AND METHOD

(76) Inventors: Anthony J. Maye, 2034 Portzer Rd., Quakertown, PA (US) 18951; Gregory P. Rochon, 870 Grantley Ct., York, PA (US) 17403

( * ) Notice: Subject to any disclaimer, the term of this patent is extended or adjusted under 35 U.S.C. 154(b) by 339 days.

(21) Appl. No.: 11/154,361

(22) Filed: Jun. 16, 2005

(51) Int. Cl.
*B65B 41/00* (2006.01)

(52) U.S. Cl. ..... 53/389.1; 53/411; 53/553; 242/421.1; 425/377; 425/461

(58) Field of Classification Search ..... 53/411, 53/553, 586, 228, 389.1; 242/421.1, 421.2, 242/421.7, 421.6; 425/377, 461, 308, 315
See application file for complete search history.

(56) References Cited

U.S. PATENT DOCUMENTS

| | | | | | |
|---|---|---|---|---|---|
| 1,941,597 | A | | 1/1934 | Cavagnaro | 271/2.4 |
| 3,270,347 | A | * | 8/1966 | Wilde | 346/8 |
| 3,278,100 | A | | 10/1966 | Hornberger | 226/189 |
| 3,503,175 | A | * | 3/1970 | Rademacher et al. | 53/412 |
| 3,669,375 | A | * | 6/1972 | Bruton | 242/417.2 |
| 3,727,820 | A | | 4/1973 | Braun | 226/113 |
| 3,822,838 | A | * | 7/1974 | Butler et al. | 242/417.2 |
| 4,114,791 | A | | 9/1978 | Schneider | 226/91 |
| 4,356,946 | A | | 11/1982 | Gaskell | 226/117 |
| 4,360,137 | A | * | 11/1982 | Noe et al. | 226/24 |
| 4,407,331 | A | * | 10/1983 | Rehling et al. | 139/110 |
| 4,782,648 | A | * | 11/1988 | Van Ottele | 53/553 |
| 4,991,376 | A | | 2/1991 | Backman | 53/399 |
| 5,031,532 | A | * | 7/1991 | Walther | 101/351.4 |
| 5,092,831 | A | | 3/1992 | James et al. | 493/394 |
| 5,355,798 | A | * | 10/1994 | Yoder, Jr. | 101/247 |
| 5,597,105 | A | | 1/1997 | Keller | 226/118 |
| 6,085,490 | A | * | 7/2000 | Buchko | 53/411 |
| 6,168,108 | B1 | * | 1/2001 | Morley | 242/421.1 |
| 6,176,181 | B1 | * | 1/2001 | Van Ryzin et al. | 101/216 |
| 6,257,862 | B1 | | 7/2001 | Nissel | 425/377 |
| 6,547,707 | B2 | * | 4/2003 | Cote | 493/13 |
| 6,587,133 | B1 | | 7/2003 | Tjoa | 347/172 |
| 6,644,185 | B1 | | 11/2003 | Rochon et al. | 101/216 |
| 6,843,038 | B1 | * | 1/2005 | Haws | 53/133.4 |
| 6,851,593 | B2 | | 2/2005 | Weber et al. | 226/188 |
| 7,100,507 | B1 | * | 9/2006 | Rochon et al. | 101/483 |

OTHER PUBLICATIONS

Form, fill and seal machines are described at pp. 1 and 2 of the specification.

* cited by examiner

*Primary Examiner*—Sameh H. Tawfik
(74) *Attorney, Agent, or Firm*—Hooker & Habib, P.C.

(57) ABSTRACT

A machine and method for printing and feeding a top web onto a bottom web in a form, fill and seal machine without stressing the bond formed between the two webs.

22 Claims, 7 Drawing Sheets

40
70
72
74
76
78
80
82
84
86
88
90
92
94
96
98

42
28
34
36
38
40
70
116
120
114
14
44
46
22

42
34
36
36
26
110
120
114'
70
114
114
44
26

WEB PRINTING AND FEED MACHINE AND METHOD

FIELD OF THE INVENTION

The invention relates to form, fill and seal machines in which pockets formed in a bottom web are filled and a printed top web is bonded onto the bottom web to seal closed the filled pockets.

BACKGROUND OF THE INVENTION

Form, fill and seal machines using printed top webs are well known. In some form, fill and seal machines, feeding of a bottom web pulls a printed top web bonded to the bottom web through a web printer, onto the bottom web and into a sealing station where the webs are heat and pressure bonded together to close filled pockets in the bottom web and form sealed packages.

Downstream feeding of the bottom web pulls the printed top web material from a supply roll, through the printer and onto the bottom web for heat and pressure bonding onto the bottom web. The high pulling force is transmitted from the bottom web to the top web through the previously formed and not yet cooled and stabilized heat and pressure bond between the webs. The pulling force stresses the bond and can rupture the bond securing the top web to the bottom web.

Form, fill and seal machines may be used to package sterile items such as pharmaceutical products, medical devices, foods and the like. A ruptured bond between the top and bottom webs due to the force required to pull the top web from the printer and onto the bottom web can destroy the sterility of the sealed pockets.

Higher speed form, fill and seal machines, the top web is fed between a pair of nip rolls located between the printer and the sealing station. The nip rolls are powered driven to pull the printed top web from the printer at a high speed and deliver the printed top web to the bottom web at the sealing station.

While the use of nip rolls to positively pull the top web from the printer for delivery to the sealing station increases throughput and reduces pulling stresses on the bond between the two webs, the nip roll engaging the top surface of the top web picks up wet ink from the top of the top web and reprints the ink on the top of the web, creating undesirable ghost images on the top web. Sealed packages with ghost images are not marketable.

Thus, there is a need for an improved web printing and feed machine which delivers printed top web to a form, fill and seal machine at low or no tension without stressing the bond between the top and bottom webs and does not print ghost images on the top web. The improved web printing and feed machine should feed top web through the machine and print the top web without increasing the tension of the top web when delivered to the form, fill and seal machine. The top web should not be fed onto the bottom web by pulling the top web through the printing and feed machine either by the bond with the bottom web or by nip rollers. The bottom web should not pull the top web through the printer and onto the bottom web. Rather, the top web should be paid out onto the bottom web under low or no tension without the use of nip rollers.

SUMMARY OF THE INVENTION

The invention is an improved web printing and feed machine used with a form, fill and seal machine and method for printing and delivering printed top web to the form, fill and seal machine without stressing the bond between the webs.

Pay out of the top web onto the bottom web does not impair the integrity of the seals for the packages formed between the webs.

The web handling and feed machine includes an infeed web brake and an outfeed web brake, and defines a web feed path that extends from the infeed web brake to the outfeed web brake. An accumulator with a drive roll on the web feed path between the infeed and outfeed web brakes selectively accumulates or pays out web. The accumulator accumulates printed web and pays out the accumulated, printed web to the form, fill and seal machine in response to machine demand.

The web handling and feed machine includes a printer or printers for printing desired images on adjacent panels on the top web. The accumulator is located at an accumulation and payout station downstream from the printer or printers where the printed top panels are accumulated. During feed of the bottom web top web is delivered from the accumulator at the accumulator station onto the top of the bottom web at low or no tension. The top web is then heat and pressure bonded onto the top of the bottom web to form a reliable pressure seal surrounding each filled packet and maintaining the sterility of the formed packages.

During operation of the web printing and feed machine, the accumulation and payout station pulls top web through the machine in steps past two printers, prints each panel with two colors and then stores printed top web panels for low or no tension delivery to the form, fill and seal machine. Top web panels are printed and fed to the accumulation and payout station between bottom web feeding steps. When a sufficient number of printed top web panels has been fed to the accumulation and payout station feeding of top web through the machine is stopped, the bottom web is fed and the printed panels on the top web in the accumulation station are delivered onto the top of the bottom web for pressure and heat seal bonding to the bottom web. Delivery of the printed top web panels onto the bottom web occurs at low or no tension and does not stress the heat and pressure bond between the two webs. In this way, the top web completely seals the tops of pockets formed in the bottom web and maintains sterility of the sealed packages.

Other objects and features of the invention will become apparent as the description proceeds, especially when taken in conjunction with the accompanying drawings illustrating the invention.

DESCRIPTION OF THE PREFERRED EMBODIMENT

Figure 1:
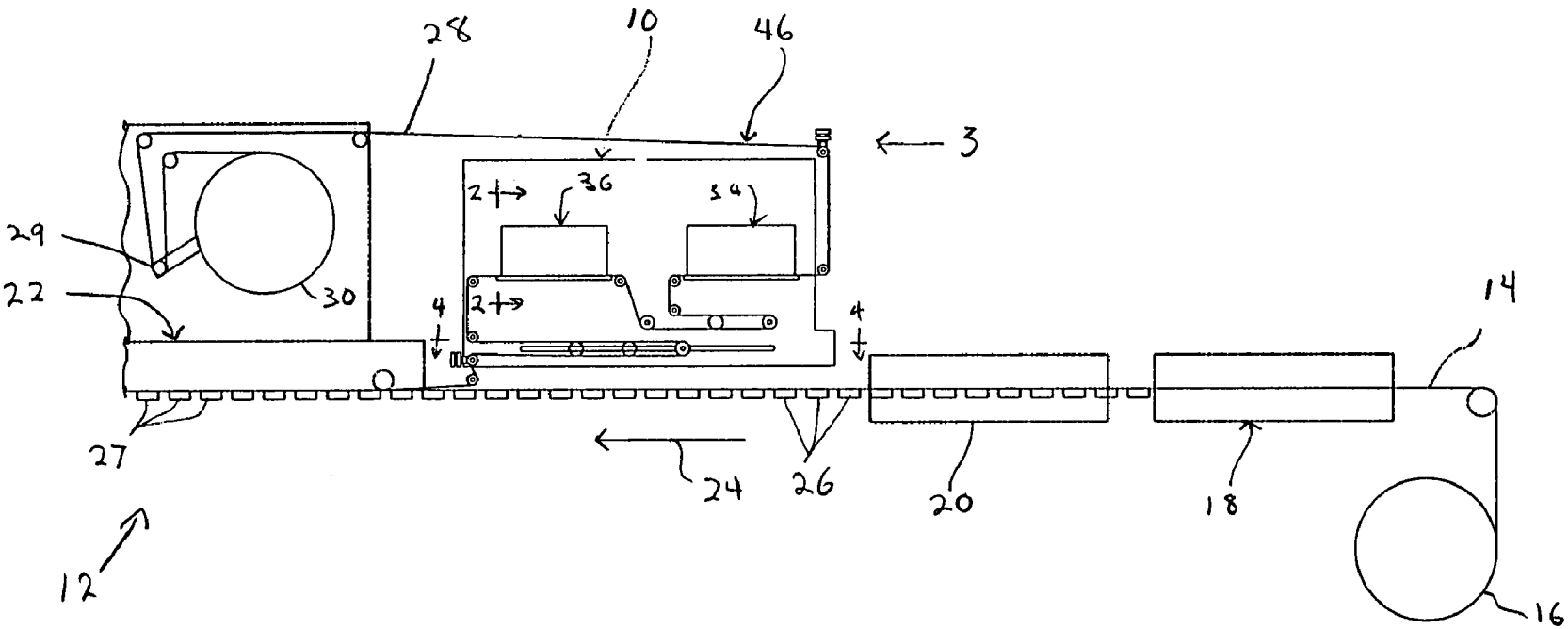
FIG. 1 is a side view of a web printing and feed machine and a form, fill and seal machine that receives printed top web panels from the web printing and feed machine.

Web printing and feed machine 10 is mounted above form, fill and seal machine 12. The machine 12 feeds an indefinite length of thermoplastic bottom web 14 from bottom web supply roll 16 through pocket forming station 18, pocket filling station 20 and sealing and punch station 22. The bottom web is fed downstream in the direction of arrow 24 in steps past stations 18, 20 and 22 by grippers located on two chains extending downstream to either side of the web. The grippers engage the side edges of the web and feed the web downstream in the direction of arrow 24 a predetermined distance in steps. The bottom web is dwelled between downstream feed steps.

When dwelled at station 18, web 14 is heated and deformed to form a plurality of spaced pockets 26 extending below the plane of the web. When the bottom web is dwelled at fill station 20, articles are placed in the pockets manually or automatically. Further downstream movement of the bottom web moves the filled pockets to sealing and punch station 22.

Top web 28 from supply roll 30 is fed past dancer roll 29 and to machine 10 where the upper surface of the top web is printed. The dancer roll maintains the top web taunt in the machine 10 to assure proper feeding and printing. The machine prints adjacent panels on the top web and pays out printed top web onto the top of the bottom web at no or low tension as the bottom web is fed into station 22. The top web is delivered onto the top of the bottom web at the same speed as the bottom web is fed downstream and is bonded onto the top of the bottom web at station 22 to close the filled pockets 26 in the bottom web and form sealed packages 27. Machine 10 feeds the top web onto the bottom web at the same speed as the two drive chains feed the bottom web downstream into station 22. Simultaneous downstream feeding of the top and bottom webs into station 22 assures reliable heat and pressure bonding between the webs without tension stressing of the seal closing the filled pockets. The top web is not pulled downstream onto the bottom web by the strength of the bond between the two webs.

As illustrated in FIGS. 7-10, web printing and feed machine 10 includes a frame 32 supporting like first and second like web printers 34 and 36; web registry station 38 between the printers; accumulation and payout station 40; infeed web brake 42 and payout web brake 44. Top web 28 is fed along a continuous non-linear top web feed path 46 extending from roll 30, past dancer roll 29, through infeed web brake 42, through first web printer 34, through web registration station 38, through second web printer 36, through accumulation and payout station 40, through payout web brake 44, around web delivery roll 114 and to sealing and punch station 22. A transverse roller 48 in station 22 is located immediately above the top of bottom web 14. Top web path 46 extends between the roller 48 and the top of the bottom web. Roller 48 holds the top web against the top of the bottom web for heat and pressure bonding against the top web at station 22.

Figure 2:
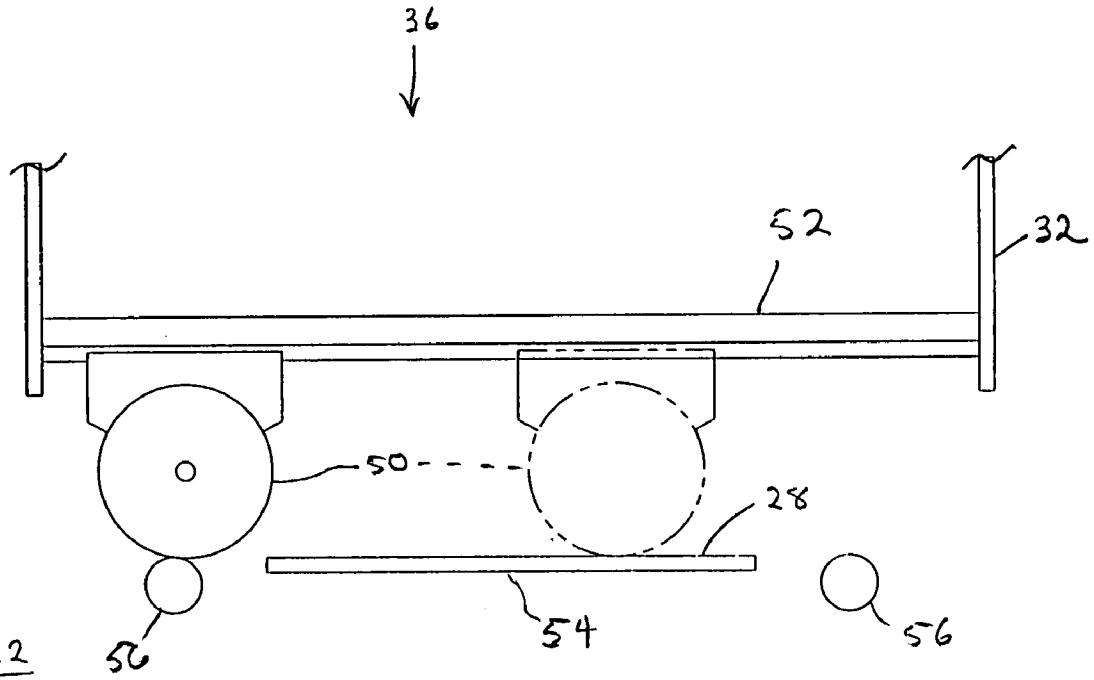
FIG. 2 is a view taken along line 2-2 of FIG. 1.

Printers 34 and 36 are preferably identical. As shown in FIG. 2, each printer includes a print drum 50 mounted on a bar 52 extending transversely across rectangular support platen 54. A cylindrical printing plate is fixed to the external surface of print drum 50 so that rotation of the drum across the platen prints indicia from the plate onto a rectangular panel on the upper surface of the top web on platen 54. During printing, movement of the top web along path 46 is dwelled so that the web is stationary on platen 54. Inking rollers 56 are located to either side of platen 54 for inking print drum 50 at the end of a printing stroke across the platen. The drum is moved across the platen in either direction to print the top of a web panel on the platen.

The printers 34 and 36 may be of the type disclosed in U.S. Pat. No. 6,644,185, assigned to the assignee of the present invention. The disclosure of U.S. Pat. No. 6,644,185 is incorporated herein by reference, in its entirety.

Web registration station 38 is located between first and second printers 34 and 36. Station 38 includes fixed guide rolls 108, 58, 60 and 110 and adjustable roll 62. The rolls extend across the top web path 46. The top web 28 extending between printed panels on the platens of the two printers extends around or is wrapped around rolls 108, 58, 62, 60 and 110 to form a registration loop 64 having an axial length between the panels determined by the adjustable position of roll 62. The position of roll 62 is adjusted on frame 32 closer to or further away from rolls 58 and 60 as required to make the length of loop 64 equal to a multiple of the length each panel and assure proper positioning of panels on the printer 36. In this way, top web panels are printed by spaced printers 34 and 36 without panel overlap or gaps between panels.

Figures 4, 5, 6:
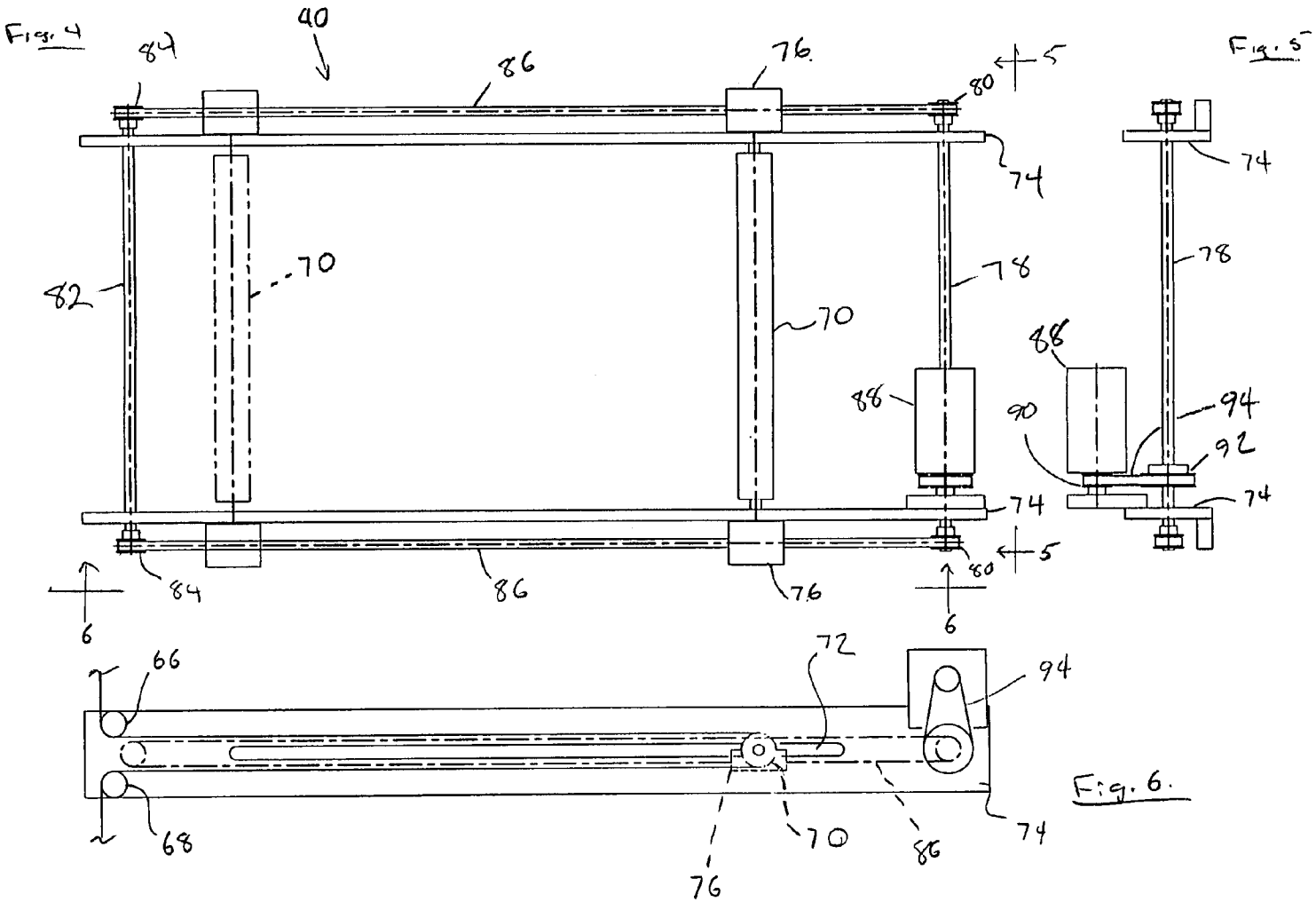
FIG. 4 is a view taken along line 4-4 of FIG. 1.
FIGS. 5 and 6 are views taken respectively along lines 5-5 and 6-6 of FIG. 4.

Station 40 is shown in FIGS. 4, 5 and 6. Station 40 includes adjacent fixed input and output rolls 66 and 68 and adjustable accumulation and feed roll 70. Rolls 66 and 68 are rotatably mounted on frame 32 and extend transversely to top web path 46. Roll 70 is adjustably mounted on the frame and is moveable toward and away from rolls 66 and 68.

The ends of roll 70 extend through longitudinal slots 72 in parallel side plates 74 mounted on frame 32 and are journaled in bearings in cars 76 located on the outside of plates 74. A drive shaft 78 is rotatably mounted on the ends of plates 74 away from rolls 66 and 68. The shaft 78 extends outwardly of plates 74 and supports sprocket gears 80. A second shaft 82 is rotatably mounted on the ends of plates 74 adjacent rolls 66 and 68. Sprocket gears 84 are mounted on the ends of shaft 82 outside of plates 74. A chain or belt 86 is wound around sprocket gears 80 and 84 outside of each plate 74. Cars 76 are attached to the lower runs of chains 86. Servomotor 88 is mounted on a plate 74 and includes an output pulley 90 connected to pulley 92 on shaft 78 by belt 94. Operation of motor 88 rotates shaft 78 to move the lower runs of chains 86 and attached adjustable roller 70 toward and away from input rolls 66 and 68. See FIGS. 4 and 6.

Figure 3:
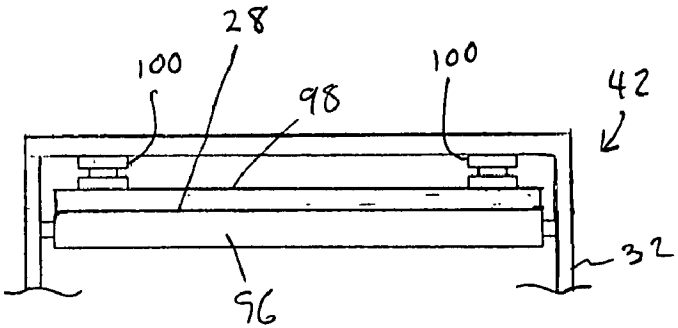
FIG. 3 is a view taken in the direction of arrow 3 of FIG. 1.
Figure 7:
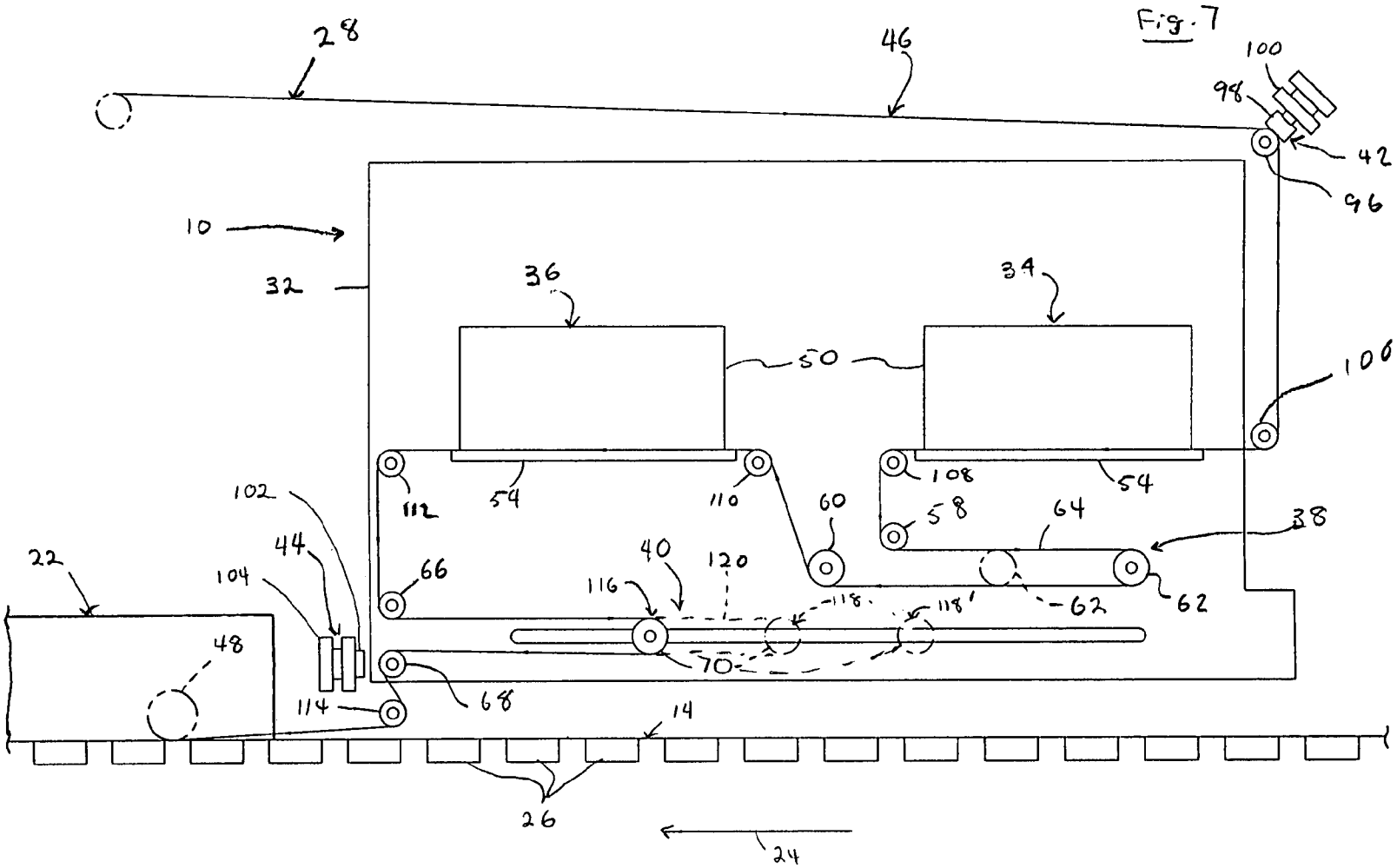
FIGS. 7-10 are enlarged side views of the web printing and feed machine illustrating operation of the machine.
Figure 8:
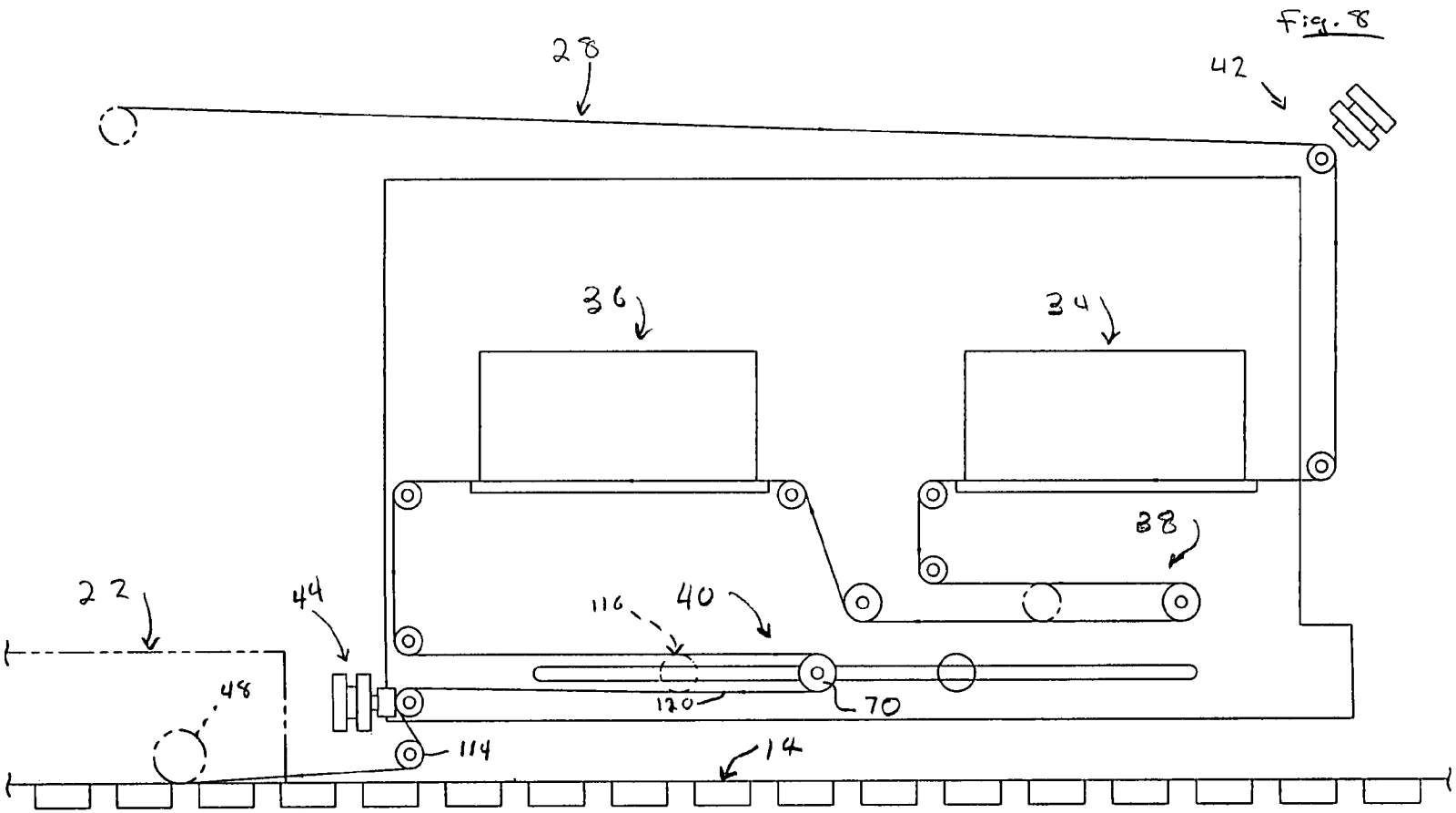
Figure 9:
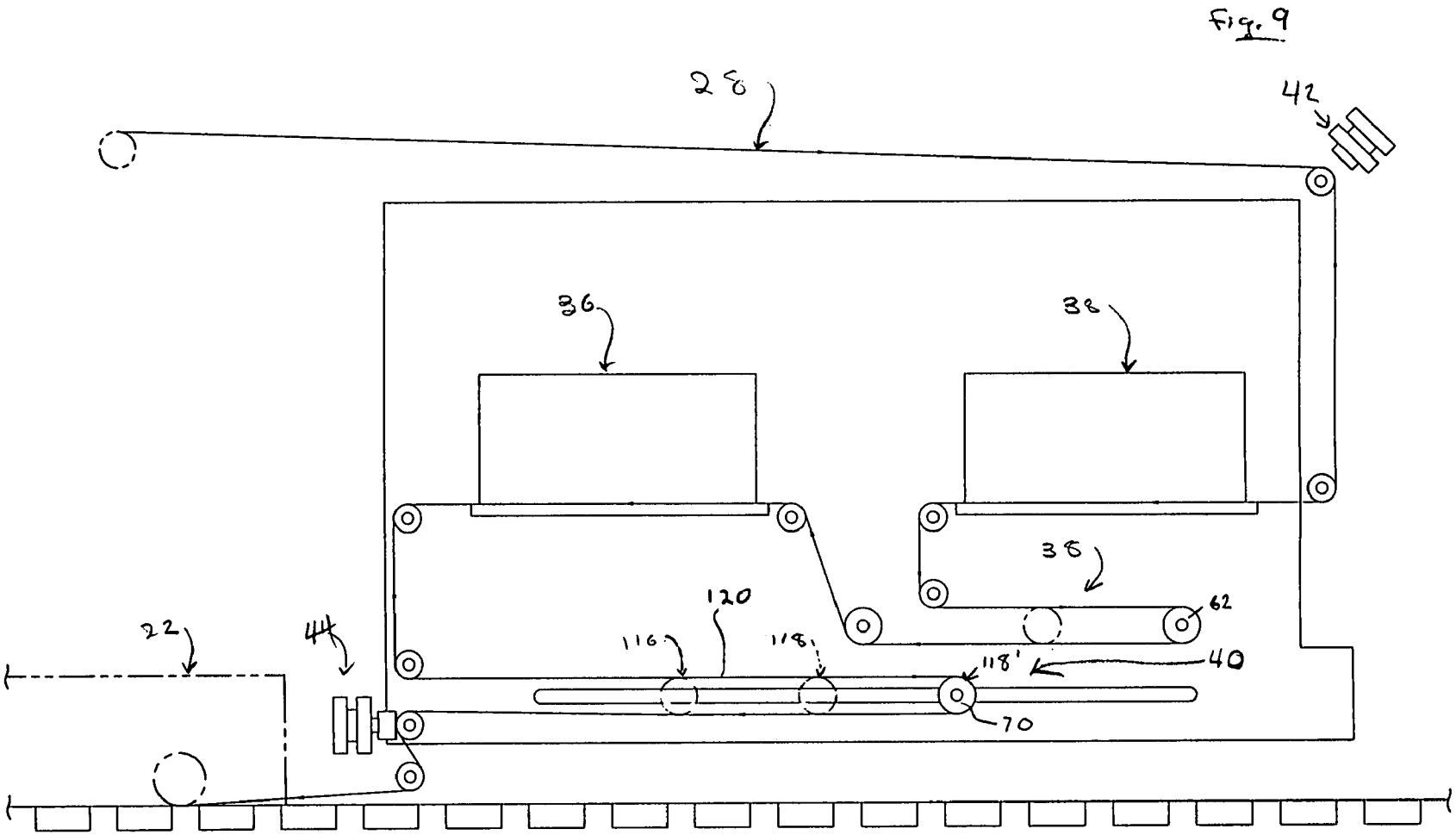
Figure 10:
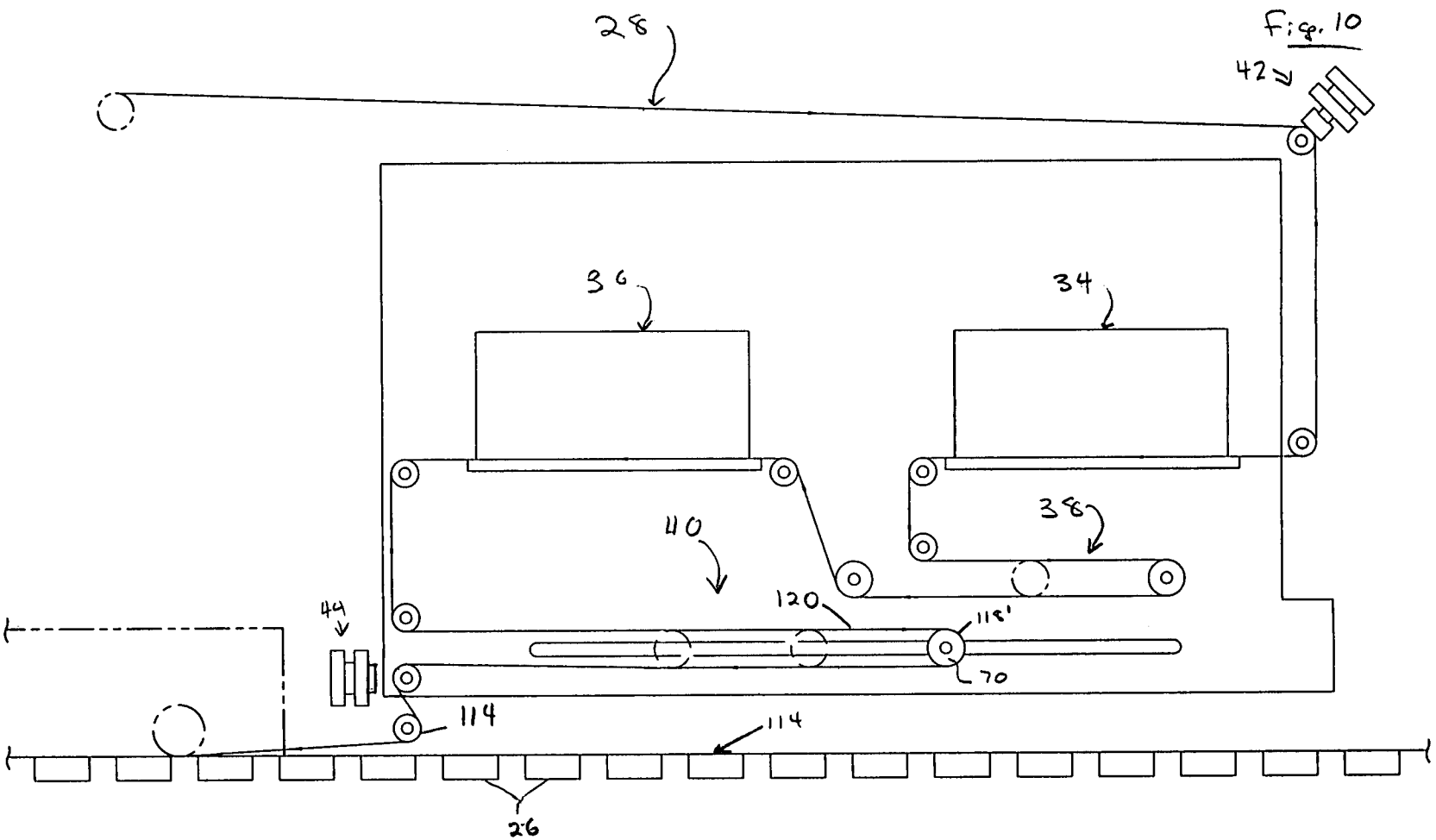

Top web guide roll 96 is mounted on frame 32 at the upper right hand corner of machine 10 as shown in FIG. 7. Infeed web brake 42 is located on the side of roll 96 away from the frame and includes a web clamp bar 98 which is moveable toward and away from roll 96 by extension and retraction of air cylinders 100 mounted on frame 32. See FIG. 3. Extension of cylinders 100 moves the bar against the roll to clamp the top web therebetween and prevent feeding of the top web past the roll.

Payout web brake 44 is similar to web brake 42 and includes a web clamp bar 102 and two air cylinders 104. The web brake 44 is also mounted on frame 32. Extension of cylinders 104 moves bar 102 against output roll 68 to clamp the top web between the bar and roll.

The top web 28 is wound around infeed and discharge guide rolls 106 and 108 located upstream and downstream from platen 54 in printer 34. Rolls 106 and 108 guide movement of the top film over the upper surface of platen 54 when print drum 50 is to one side of the platen.

Likewise, infeed guide roll 110 and discharge guide roll 112 are located upstream and downstream of platen 54 of printer 36. These rolls guide top web 28 over platen 54 of printer 36 when the print drum 50 is located to one side of the platen.

Machine 10 includes a web delivery roll 114 located beneath roll 68 and at a short distance above the top of the bottom web 14. Printed top film delivered from machine 10 to sealing and punch station 22 is wound around output roll 68 and delivery roll 114 to assure that the top web is delivered to roll 48 in station 22 very nearly parallel to the upper surface of the bottom web 14 to facilitate heat and pressure sealing the two webs together at the station.

Machines 10 and 12 are operated by an electronic controller and associated servomotors. A servomotor feeds the chains moving bottom web 14 downstream in steps in the direction of arrow 24. Servomotor 88 of accumulation and payout station 40 moves feed roll 70. Servomotors operate web printers 34 and 36. The encoders on the servomotors are connected to the controller which actuates the motors at appropriate intervals, as described below. The controller actuates valves for extending and retracting the air cylinders of web brakes 42 and 44.

Servomotor 88 moves roll 70 from a predetermined registration or home position 116 adjacent rolls 66 and 68 to one or more spaced dwell positions 118, 118' located further away from rolls 66 and 68. The registration position 116 is selected in order to assure that the printed panels on the top web are in proper registration with the bottom web when the top web is delivered onto and sealed against the top of the bottom web to close filled pockets 26.

FIGS. 7-10 illustrate the positions of machines 10-12 during a single cycle of operation. The web printing and feed machine 12 is set up for printers 34 and 36 to print two colors on each adjacent top web panel. Station 40 feeds two printed two-color panels to sealing and punch station 22 during each cycle of operation.

If desired, machine 10 may be adjusted so that printers 34 and 36 print single color images on adjacent top web panels and station 40 delivers two or four single color printed panels to station 22 during each cycle of operation.

FIG. 7 illustrates the position of machines 10 and 12 at the beginning of a cycle of operation of machine 10. Web brake 42 engages roll 96 to prevent feeding of top web into machine 10. Web brake 44 is disengaged. Roller 70 is in registration position 116. Printed top web from station 40 has been fed to station 22. The panels of top web 28 on both printer platens have been printed, the print drums 50 are located to one side of platens 54 and are inked and ready for printing. The drive for indexed bottom web 14 downstream is deactivated by the controller so that the bottom web is motionless.

To start a cycle of operation the controller deactivates web brake 42 to permit feeding of top web 28 into machine 10, activates web brake 44 to prevent delivery of top web from machine 10. Servomotor 88 is actuated to move feed roller 70 from registration position 116 away from rollers 66 and 68 to first dwell position 118, to feed an additional printed panel into loop 120 and increase the length of the top web in accumulation loop 120 by the axial length of the panel. The roller 70 moves a distance equal to one-half the length of a panel. The newly printed panels of the top web are fed downstream from printers 34 and 36. An unprinted top web panel is fed into printer 34. A one color printed top web panel is fed into printer 36. The controller then stops motor 88 and actuates both printers to print the top web panels. See FIG. 8. After printing, motor 88 is again actuated to move roll 70 to the second dwell position 118' and feed additional top web panels into the printers and feed an additional fully printed top web panel into loop 120. The feed is stopped and the printers are actuated to print the top web panels. See FIG. 9.

After a second printing cycle has been completed brake 42 is engaged, brake 44 is disengaged. See FIG. 10. Servomotor 88 of station 40 is actuated to move roll 70 a short distance toward rolls 66 and 68, about one-eighth inch, to loosen the top web in loop 120 about ¼ inch and loosen the portion of the top web extending to roll 48 and the bottom web. After loosening of the portions of the top web, servo drive motor 88 remains actuated and the drive motor for the bottom web is actuated to move the bottom web downstream. Roll 70 moves toward the registration position at one-half the speed the bottom web is moved downstream so that loose top web in the accumulation loop 120 is delivered tension free or at low tension to roller 48 in sealing and punch station 22 and onto the bottom web. Both webs move into station 22 at the same speed.

Loosening of the top web by initial movement of roller 70 before the bottom web is fed, followed by continued movement of roller 70 to payout top web to station 22 at the speed the bottom web is fed to the station assures that the printed top web is paid out onto the bottom web without stressing the bond previously formed between the top web and the bottom web. The heat and pressure bond formed between the webs during the previous cycle of operation typically may not be fully cooled and stabilized before the webs are fed during the next cycle of operation. Machine 10 pays out top web freely to station 22. The top web is not pulled from the printer and into the station under tension.

At the end of the feed stroke of bottom web 14 roller 70 has returned to registration or home position 116, the ¼ inch prefeed slack in loop 120 has been taken up and two printed top web panels have been fed onto the bottom web to cover and seal the filled pockets 22 fed to station 22. Roller 48 assures that the low-tension top web is delivered directly to the top of the bottom web. At this time, downstream movement of the bottom web ceases and tooling at station 22 heat and pressure bonds the webs together. Punch tooling in station 22 severs the sealed pockets from the upstream portion of the two webs to complete the cycle of operation.

Form, fill and seal machine 12 manufactures filled, sealed packages from top web 28 and bottom web 14 at a high production rate of about 15 cycles per minute with each cycle bonding together 60 inch lengths of top and bottom web. Machine 10 may use printers with print drums 50 each having an axial length of about 30 inches for printing 30-inch long print panels on the top web. The top web is paid out freely onto the bottom web at a high speed of 60 inches per second and at low tension.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention:

1. A web handling system for receipt, printing, and payout of web to an intermittent form, fill, and seal machine having a dwell period and a payout period, the web handling system comprising:

an infeed web brake, an outfeed web brake, and a web feed path defined by the web handling system, at least a portion of the web feed path extending downstream from the infeed web brake to the outfeed web brake, the infeed web brake when actuated preventing feed of web into the web handling system, the outfeed brake when actuated preventing pay out of web from the web handling system;

a printer located on the web feed path between the infeed web brake and the outfeed web brake, the printer configured to print on a web surface while the surface is stationary on the web path;

an accumulator located on the web feed path between the infeed web brake and the outfeed web brake and downstream from the printer;

the accumulator comprising an accumulator roll extending across the web feed path, the web feed path looping around the accumulator roll, the accumulator roll movable between a home position and a dwell position for accumulating web and movable from the dwell position the home position for paying out web; and means operable during the dwell period of the form, fill, and seal machine to move the accumulator roll from the home position to the dwell position while the infeed web brake is not actuated and the outfeed web brake is actuated for feed of unprinted web into the web handling system and to the printer for printing, said means operable during the payout period of the form, fill, and seal machine to move the accumulator roll from the dwell position to the home position while the infeed web brake is actuated and the outfeed web brake is not actuated for payout of printed web from the web handling system to the form, fill, and seal machine.

2. The web handling system of claim 1 wherein web looping around the accumulator roll defines a web loop and said means is operable to move the accumulator roll from the dwell position towards the home position while the outfeed brake is actuated to space the accumulator roll from the web loop before paying out web from the web handling system.

3. The web handling system of claim 2 wherein said means is operable to move the accumulator roll towards the home position at the same speed as the web loop during pay out of web from the web handling system so that the accumulator roll does not impede movement of the web loop during web pay out for essentially tension-free pay out of web to the form, fill, and seal machine.

4. The web handling system of claim 3 in combination with an intermittent form, fill and seal machine, the machine comprising means for pulling web from the web handling system during the payout period of the form, fill, and seal machine.

5. The combination recited in claim 4 wherein the means for pulling web does not comprise nip rolls.

6. The web handling system of claim 1 wherein said means is operable to move accumulator roll from the dwell position towards the home position at a speed at least equal to the speed of the web loop during pay out of web from the web handling system wherein the accumulator roll does not impede movement of the web loop during web pay out from the accumulator for delivery of essentially tension-free web to the form, fill, and seal machine.

7. The web handling system of claim 6 in combination with an intermittent form, fill and seal machine, the machine comprising means for pulling web from the web handling system during the payout period of the machine.

8. The combination recited in claim 7 wherein the means for pulling web does not comprise nip rolls.

9. The web handling system of claim 1 wherein the printer is operable to print on the web while the infeed web brake is actuated and the accumulator roll is at the dwell position.

10. The web handling system of claim 1 wherein the printer is a rotary printer.

11. The web handling system of claim 1 wherein the printer comprises first and second printers located on the web path, the second printer spaced downstream from the first printer, each printer configured to print on a stationary surface.

12. The web handling system of claim 11 wherein the dwell position of the accumulator roll represents a final dwell position, and the accumulator roll moves from the home position and dwells at an intermediate dwell position while moving from the home position to the final dwell position; and the first and second printers are configured to print on the web while the accumulator roll is at the intermediate and final dwell positions.

13. The web handling system of claim 12 wherein said means is operable to move the accumulator roll from each of the home position to the intermediate dwell position and from the intermediate dwell position to the final dwell position a distance that moves a web surface printed by the first printer into registration with the second printer, whereby the second printer overprints the printing of the first printer.

14. The web handling system of claim 13 comprising means for adjusting the print registration.

15. A web handling system for payout of essentially tension-free printed web to a device that pulls in web at an input speed during an intake portion of a machine cycle and dwells web for a remaining dwell portion of the machine cycle, the web handling system comprising:

an infeed web brake, an outfeed web brake, and a web feed path defined by the web handling system, at least a portion of the web feed path extending downstream from the infeed web brake to the outfeed web brake, the infeed web brake when actuated preventing feed of web into the web handling system, the outfeed brake when actuated preventing pay out of web from the web handling system;

a printer located on the web feed path between the infeed web brake and the outfeed web brake for printing on the web;

an accumulator located on the web feed path downstream from the printer and between the infeed web brake and the outfeed web brake;

the accumulator comprising an accumulator roll extending across the web feed path, and drive means for moving the accumulator roll, said drive means operable to move the accumulator roll between a home position and a dwell position for accumulating web, and said drive means operable to move the accumulator roll from the dwell position to the home position for paying out web, said drive means comprising a drive that moves the accumulator roll independently of the tension in the web;

the web feed path looping around the accumulator roll, the web looping around the accumulator roll defining a web loop that moves towards the home position during movement of the accumulator roll towards the home position during pay out of web;

the drive means operable to move the accumulator roll from the home position to the dwell position while the infeed web brake is not actuated and the outfeed web brake is actuated for receipt of unprinted web into the web handling system and to the printer for printing, and the drive means operable to move the accumulator roll from the dwell position to the home position while the infeed web brake is actuated and the outfeed web brake is not actuated for payout of printed web from the web handling system and to the machine;

the drive moving the accumulator roll towards the home position at the same speed as the web loop during pay out of web from the web handling system, wherein the accumulator roll does not resist movement of the web loop towards the home position so that the machine pulls in essentially stress-free web from the web handling system.

16. The web handling system of claim 15 wherein the drive means is operable to move the accumulator roll from the dwell position towards the home position while the outfeed brake is actuated to space the accumulator roll from the web loop before pay out of web from the web handling system.

17. The web handling system of claim 15 wherein the web loop moves at half the speed of the web being discharged from the web handling system.

18. The web handling system of claim 15 wherein the accumulator roll is stationary at the dwell position while the printer prints on the web.

19. The web handling system of claim 15 wherein the printer comprises first and second printers located on the web path, the second printer spaced downstream from the first printer, each printer configured to print on a stationary surface.

20. The web handling system of claim 19 wherein the dwell position of the accumulator roll represents a final dwell position, and the drive means is operable to dwell the accumulator roll at an intermediate dwell position when moving the accumulator roll from the home position to the final dwell position; and the first and second printers both print on the web while the accumulator roll is at the intermediate dwell position and the first and second printers both print on the web while the accumulator roll is at the final dwell position.

21. The web handling system of claim 20 wherein the drive means is operable to move the accumulator roll from each of the home position to the intermediate dwell position and the intermediate dwell position to the final dwell position a distance that moves web from the first printer into registration with the second printer, whereby the second printer overprints the printing of the first printer.

22. The web handling system of claim 21 comprising means for adjusting the print registration.

* * * * *